US005616098A

United States Patent [19]

Katayama et al.

[11] Patent Number: 5,616,098

[45] Date of Patent: Apr. 1, 1997

[54] REDUCTION MECHANISM FOR MILL AND MILL HAVING THE SAME

[75] Inventors: Masanori Katayama, Ibaraki-ken; Hiroshi Agata, Ryugasaki, both of Japan

[73] Assignee: Hitachi, Ltd., Tokyo, Japan

[21] Appl. No.: 514,737

[22] Filed: Aug. 14, 1995

[30] Foreign Application Priority Data

Sep. 20, 1994 [JP] Japan ..... 6-224772

[51] Int. Cl.[6] ..... B02C 15/00

[52] U.S. Cl. ..... 475/346; 384/308

[58] Field of Search ..... 384/306, 308, 384/309; 475/346

[56] References Cited

U.S. PATENT DOCUMENTS

| | | | |
|---|---|---|---|
| 1,378,545 | 5/1921 | Kingsbury | 384/308 |
| 3,829,180 | 8/1974 | Gardner | 384/306 |
| 4,103,979 | 8/1978 | Kuhn | 384/306 |
| 4,471,671 | 9/1984 | Sigg | 475/346 |
| 4,738,550 | 4/1988 | Gardner | 384/306 |

OTHER PUBLICATIONS

Japanese Patent Unexamined Publication No. 3–282045.

"Reduction Mechanism for Vertical Pulverizer" described in Industrial Machinery (Dec., 1983).

*Primary Examiner*—Dirk Wright

*Attorney, Agent, or Firm*—Antonelli, Terry, Stout & Kraus, LLP

[57] ABSTRACT

A reduction mechanism for mill comprises a planetary gear train comprising a sun gear, planet gears, an internal gear and a carrier for supporting the planet gears; an input shaft for feeding power; a sun gear shaft on which the sun gear is mounted; an intermediate shaft interposed between the sun gear shaft and the input shaft; an output table for transferring rotary power; a thrust bearing for supporting the output table; and a case for enveloping the planet gear train and the thrust bearing. A tilting pad type bearing is used for the thrust bearing. The thrust supporting portion of the tilting pad type bearing is formed spherically. The center of the spherical surface is positioned between inside and outside diameters of a vertical portion of the case which receives a thrust force.

3 Claims, 5 Drawing Sheets

REDUCTION MECHANISM FOR MILL AND MILL HAVING THE SAME

BACKGROUND OF THE INVENTION

1. Field of the Invention

The present invention relates to a reduction mechanism for driving a mill for pulverizing coal, cement or the like, and a mill having the same reduction mechanism.

2. Description of the Prior Art

In conventional reduction mechanism for driving a vertical mill for pulverizing coal, cement or the like, an impulsive pulverizing force is applied to an output table and received by a cylindrical case through a thrust bearing. However, thrust supporting portion of the thrust bearing is not so designed as to align with the center between inside and outside diameters of the cylindrical case. Even if they are aligned with each other, load is sustained by the whole surface of the thrust supporting portion of the thrust bearing.

Examples of this kind of technology are "Reduction mechanism for vertical pulverizer" described in "Industrial Machinery" (1983. 12) and the one disclosed in Japanese Patent Unexamined Publication No. 3-282045.

In the case where the thrust supporting portion of the thrust bearing is not positioned between the inside and outside diameters of a vertical portion of the cylindrical case which receives the thrust force, or in the case where the load is sustained by the whole surface of the thrust supporting portion of the thrust bearing, the cylindrical case is applied with moment load and deformed, and therefore an internal gear formed directly on the inner surface of the case is influenced by the deformation of the cylindrical case to deteriorate tooth bearing, and vibration is transmitted to the cylindrical case and the whole reduction mechanism to increase noise. However, these problems have been neglected. Further, no consideration has been given to another problem that, since the connections between the output table and a carrier and between a sun gear shaft and an intermediate shaft are made by means of rigid bodies, the sun gear can not move freely, and accordingly the tooth bearing is deteriorated and power is not distributed equally to thereby increase noise.

An object of the present invention is to provide a reduction mechanism for mill which is little suffered from deformation of a case, deterioration of tooth bearing, unequal distribution of power, and vibration and noise, and a mill having the same reduction mechanism.

SUMMARY OF THE INVENTION

The above object can be attained by a reduction mechanism for mill comprising: a planetary gear train comprising a sun gear, planet gears, an internal gear and a carrier for supporting the planet gears; an input shaft for feeding power; a sun gear shaft which rotates the sun gear mounted thereon; an intermediate shaft interposed between the sun gear shaft and the input shaft; an output table for transferring rotary power; a thrust bearing for supporting the output table; and a case for enveloping the planetary gear train and the thrust bearing, wherein the thrust bearing comprises a tilting pad type bearing, the thrust supporting portion of the tilting pad type bearing being formed spherically, the center of the spherical surface being positioned between inside and outside diameters of a vertical portion of the case which receives a thrust force.

The above object can also be achieved by a reduction mechanism for mill comprising: a planetary gear train comprising a sun gear, planet gears, an internal gear and a carrier for supporting the planet gears; an input shaft for feeding power; a sun gear shaft which rotates the sun gear mounted thereon; an intermediate shaft interposed between the sun gear shaft and the input shaft; an output table for transferring rotary power; a thrust bearing for supporting the output table; and a case for enveloping the planetary gear train and the thrust bearing, wherein the thrust bearing comprises a tilting pad type bearing, the thrust supporting portion of the tilting pad type bearing being formed spherically, the center of the spherical surface being positioned between inside and outside diameters of a vertical portion of the case which receives a thrust force, and the internal gear is formed separately from the case and fixed thereto using fixing means.

Further, the above object can be accomplished by a reduction mechanism for mill comprising: a planetary gear train comprising a sun gear, planet gears, an internal gear and a carrier for supporting the planet gears; an input shaft for feeding power; a sun gear shaft which rotates the sun gear mounted thereon; an intermediate shaft interposed between the sun gear shaft and the input shaft; an output table for transferring rotary power; a thrust bearing for supporting the output table; and a case for enveloping the planetary gear train and the thrust bearing, wherein the thrust bearing comprises a tilting pad type bearing, the thrust supporting portion of the tilting pad type bearing being formed spherically, the center of the spherical surface being positioned between inside and outside diameters of a vertical portion of the case which receives a thrust force, and a lower end surface of the sun gear shaft is formed spherically, the lower end of the sun gearshaft being connected to the intermediate shaft using spline structure.

Moreover, the above object can be attained by a mill having a reduction mechanism and pulverizing coarse material to be crushed into fine powder, the reduction mechanism comprising a planetary gear train comprising a sun gear, planet gears, an internal gear and a carrier for supporting the planet gears, an input shaft for feeding power, a sun gear shaft which rotates the sun gear mounted thereon, an intermediate shaft interposed between the sun gear shaft and the input shaft, an output table for transferring rotary power, a thrust bearing for supporting the output table, and a case for enveloping the planetary gear train and the thrust bearing, the thrust bearing comprising a tilting pad type bearing, the thrust supporting portion of the tilting pad type bearing being formed spherically, the center of the spherical surface being positioned above a vertical portion of the case which receives a thrust force.

The thrust supporting portion of the tilting pad type bearing is aligned with the center between the inside and outside diameters of the vertical portion of the case, and therefore an impulsive pulverizing force applied to the output table can be received only by the vertical portion of the case which receives the thrust force, and no bending moment is applied to the case. In consequence, the case never be deformed to prevent the deterioration of tooth bearing and unequal distribution of power, resulting in the reduction of vibration and noise of the reduction mechanism.

The internal gear is formed separately from the case and fixed thereto by fixing means, and therefore the internal gear never be applied with thrust load to prevent the deterioration of tooth bearing. Further, vibration is hardly transmitted to the internal gear. As a result, vibration and noise of the reduction mechanism can be reduced.

The sun gear shaft, having its lower surface formed spherically, is connected to the intermediate shaft using the spline structure, and therefore the sun gear shaft can move freely. In consequence, it becomes easy to distribute the load equally among the three planet gears, and vibration and noise of the reduction mechanism can be reduced.

DESCRIPTION OF PREFERRED EMBODIMENTS

Figure 1:
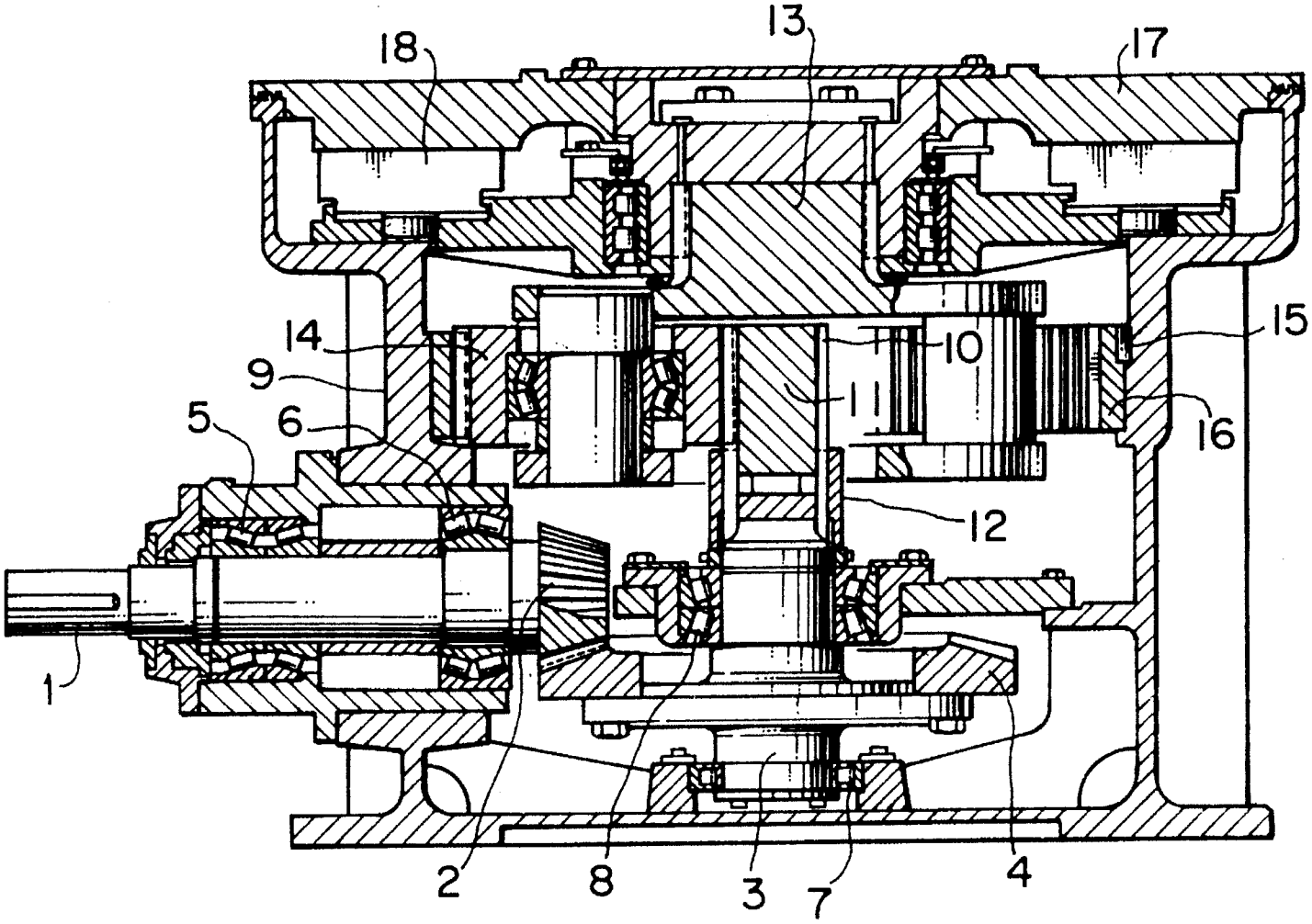
FIG. 1 is a vertical sectional view of a first embodiment of the present invention.
Figure 2:
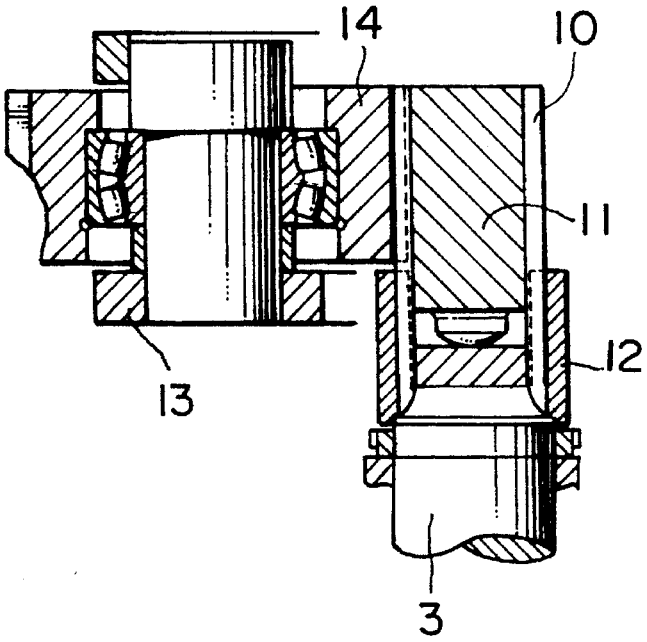
FIG. 2 is a partial sectional view of the embodiment of FIG. 1, showing an intermediate shaft and its vicinity.
Figure 3:
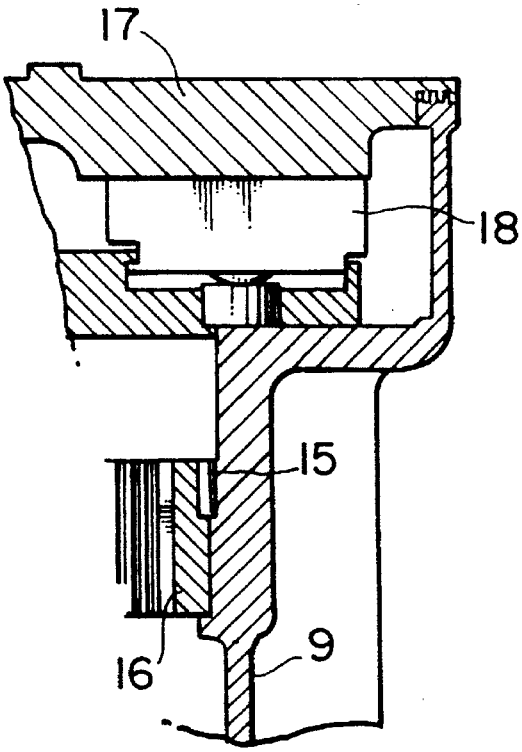
FIG. 3 is a partial sectional view of the embodiment of FIG. 1, showing the thrust supporting portion and its neighborhood.

Description will be given below of a first embodiment of the present invention with reference to FIGS. 1 to 3.

Reduction mechanism of this embodiment is a double-reduction mechanism applied to a mill for pulverizing coal into fine powder. A bevel pinion 2 is fixed at the tip end of an input shaft 1, and a bevel gear 4 is fixed on an intermediate shaft 3. The bevel pinion 2 and the bevel gear 4 are in mesh with each other so that rotation of the input shaft 1 is slowed down and transmitted to the intermediate shaft 3. The input shaft 1 is supported by a cylindrical case 9 through bearings 5, 6, while the intermediate shaft 3 is supported by the cylindrical case 9 through bearings 7, 8. More specifically, as shown in FIG. 2, the intermediate shaft 3 is connected to a sun gear shaft 11, having a sun gear 10 fixed thereon and rotating the same, with a coupling 12 by making use of the spline structure. The lower surface of the sun gear shaft 11 is formed spherically. The sun gear 10 is in mesh with three planet gears 14 supported by a carrier 13, and the planet gears 14 are in mesh with an internal gear 16 fixed at plural points to the cylindrical case 9 with pins 15. The carrier 13 is connected to an output table 17 using the spline structure, and the output table 17 is supported by the cylindrical case 9 through a thrust bearing 18 of tilting pad type. The carrier 13 supports the three planet gears 14, and the sun gear 10, three planet gears 14 and internal gear 16 are combined to form a planetary gear train. The supporting portion of the thrust bearing 18 is formed spherically at its lower end surface as shown in detail in FIG. 3, and the center of the spherical surface is positioned between inside and outside diameters of the vertical portion of the cylindrical case 9 which receives the thrust force, and more preferably, aligned with the center between these inside and outside diameters.

Next, operation of this embodiment will be described.

Rotation of motor or turbine is transmitted through a coupling (not shown) to the input shaft 1, from which the rotation is transmitted through the bevel pinion 2 to the bevel gear 4 to rotate the intermediate shaft 3. At this time, rotation of the input shaft 1 is slowed down and transmitted to the intermediate shaft 3. Rotation of the intermediate shaft 3 is transmitted through the coupling 12 to the sun gear shaft 11, and rotation of the sun gear shaft 11 is transmitted through the sun gear 10 to the three planet gears 14 supported by the carrier 13 to be further slowed down. In consequence, the output table 17 connected to the carrier 13 using the spline structure is driven to rotate at low speed. Tires, made of ceramic or the like material, are rotatably supported on the output table 17 with or without a slight gap left therebetween (although not shown), so that coarse coal particles are fed from outside to be introduced between the output table 17 and the tires, and accordingly the coarse coal particles are pulverized by the pressure of the tires.

In the reduction mechanism for driving the coal mill, an impulsive pulverizing force is applied to the output table 17, and therefore the cylindrical case 9 receives it through the thrust bearing 18 of tilting pad type in this embodiment. The thrust bearing 18 is constructed such that the thrust supporting portion thereof is positioned between the inside and outside diameters of the cylindrical case 9, and therefore the cylindrical case 9 never be subjected to moment load, and accordingly the cylindrical case 9 is prevented from being deformed. Since the cylindrical case 9 is not deformed, there is no possibility that tooth bearing of the gears of the planetary gear train is deteriorated. Further, the cylindrical case 9 and the internal gear 16 are formed separately from each other, and therefore the internal gear 16 never be subjected to the thrust load, and accordingly deterioration of tooth bearing can be prevented. Moreover, vibration from the mill is hardly transmitted to the internal gear 16, carrier 13 or planet gears 14, and therefore vibration and noise of the whole apparatus can be reduced. In addition, since the sun gear shaft 11 can move freely by the spherical lower surface, the load can be distributed equally among the three planet gears 14.

According to the present embodiment, the case of the reduction mechanism for mill is prevented from being deformed, and therefore the tooth bearing is prevented from being deteriorated. In consequence, there is no possibility of unequal load distribution among the planet gears, thereby making it possible to reduce the vibration and noise of the reduction mechanism.

Figure 4:
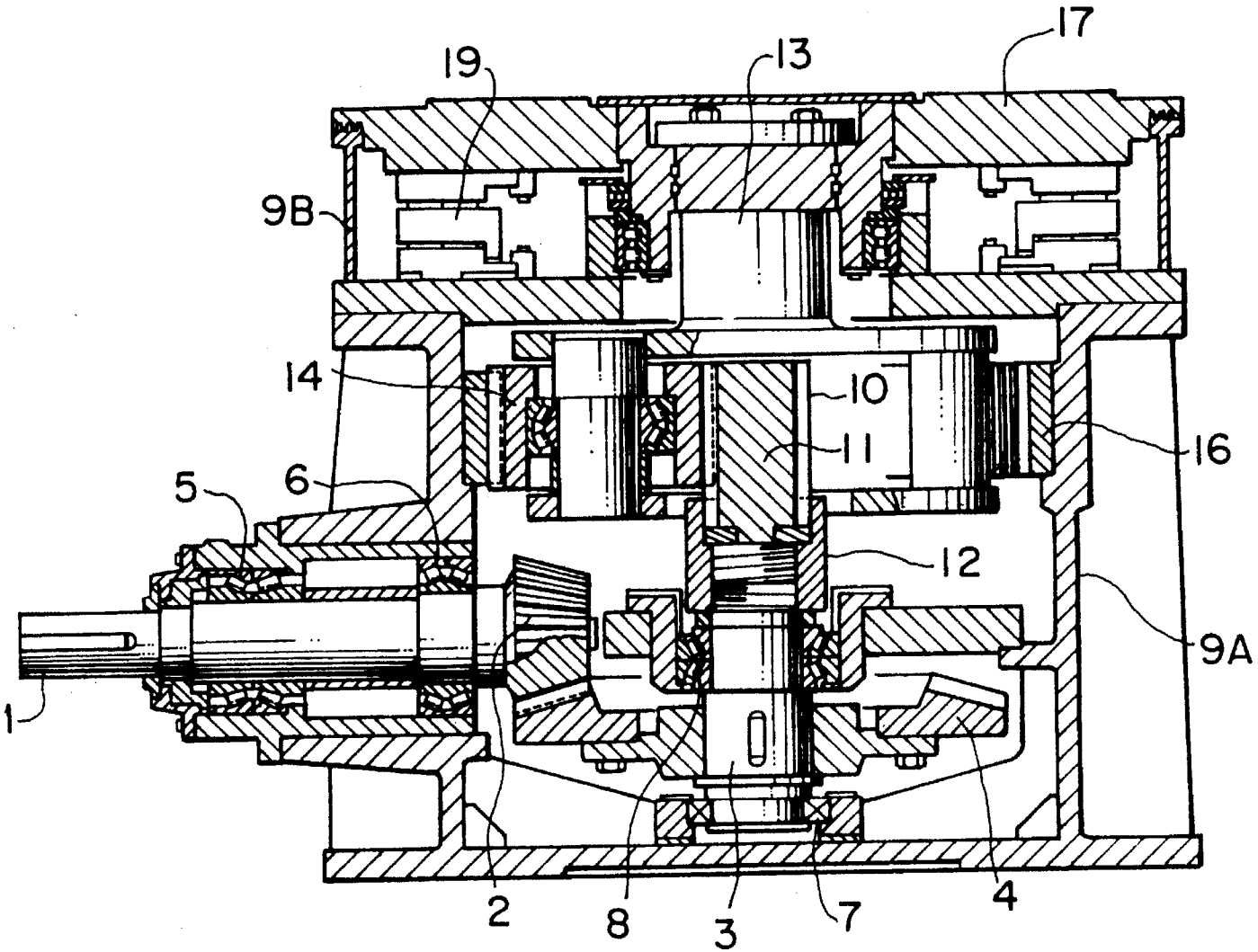
FIG. 4is a vertical sectional view of a second embodiment of the invention.

Next, a second embodiment of the present invention will be described by referring to FIG. 4.

The point of difference from the first embodiment is that a cylindrical rolling bearing 19 is used for the thrust bearing and the cylindrical case 9 is divided into an upper case 9B and a lower case 9A. The fixed ring of the rolling bearing 19 is set on the upper case 9B, and the center of the fixed ring of the cylindrical rolling bearing 19 is positioned between inside and outside diameters of the lower case 9A (preferably, aligned with the center between these diameters), and a width of contact of the fixed ring with the upper case 9B is made equal to a thickness of the vertical portion of the lower case 9A, thereby preventing the upper case 9B from being applied with the bending moment.

Since the cylindrical rolling bearing is used for the thrust bearing, the upkeep of the bearing can be done only by controlling the oil temperature, so that maintenance is hardly required as compared with the sliding bearing. Further, large thrust load capacity can be attained regardless of the number of revolution, and therefore the cylindrical rolling bearing is also suitable for the mill the thrust load of which is large even at the time of starting. Further, when the sliding bearing is used in the mill the thrust load of which is large upon starting, a hydraulic lift-up mechanism is needed, but in the case of cylindrical rolling bearing, the hydraulic lift-up mechanism is not needed. Accordingly, it is possible to make the lubricating device simple in structure.

Figure 5:
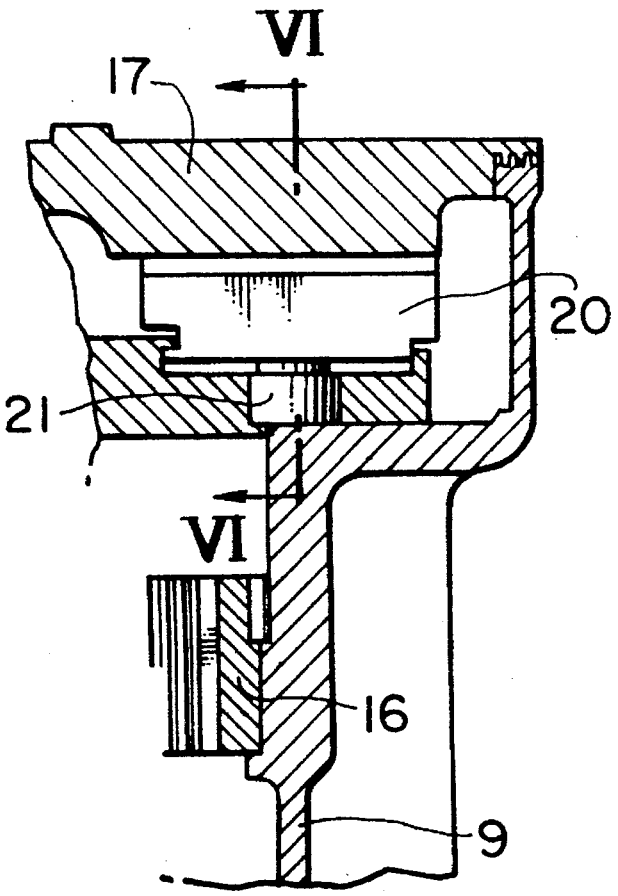
FIG. 5 is a vertical sectional view of a third embodiment of the invention.
Figure 6:
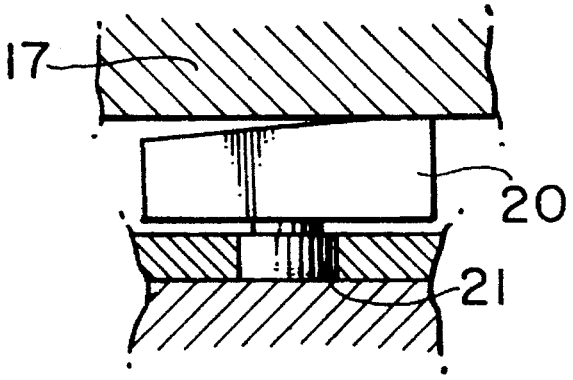
FIG. 6 is sectional view taken along the line VI—VI of FIG. 5.

Next, a third embodiment of the present invention will be described with reference to FIG. 5 and FIG. 6.

The point of difference from the first embodiment is that a taper land thrust bearing 20 is used for the thrust bearing. More specifically, as shown in FIG. 6, the bottom surface of the taper land bearing 20 is formed with a cylinder and it is supported by a support pin 21 having a diameter larger than that of the cylinder. In a taper land bearing, a wedge-effect is obtained at a tapered surface thereof, so that it is not necessary to incline the taper land bearing 20. Therefore, spherical working of a bottom surface of the bearing becomes unnecessary. Accordingly, it is sufficient to form the cylinder having a flat surface at the bottom surface of the bearing, and therefore it is easy to machine.

Figure 7:
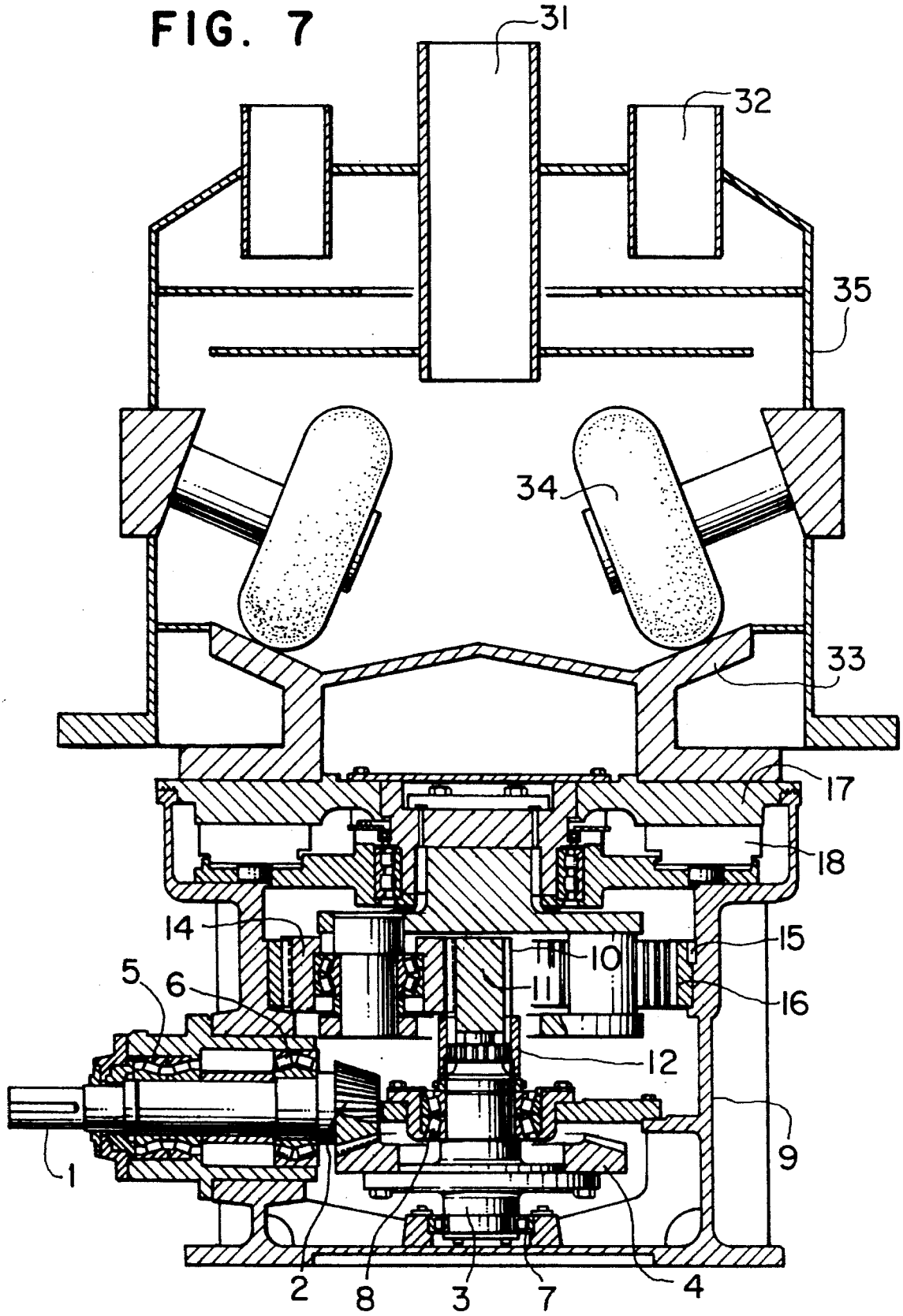
FIG. 7 is a vertical sectional view of an embodiment where the reduction mechanism for mill according to the first embodiment is employed in a coal mill.

FIG. 7 is a vertical sectional view of a coal mill using the reduction mechanism for mill of the first embodiment.

Coal mill is an apparatus for pulverizing coal into fine powder for the purpose of enhancing the combustion efficiency in the thermal electric power plant. The coal mill comprises a raw coal inlet 31 through which the raw coal is thrown in, a pulverized coal outlet 32 from which the pulverized coal is taken out, a yoke 33 mounted on the output table 17 of the reduction mechanism, a plurality of rotatable roller tires 34, and a mill housing 35.

The coal thrown in through the raw coal inlet 31 is pulverized between he yoke 33 and the roller tires 34, and the thus-pulverized coal is taken out from the pulverized coal outlet 32 and fed to a boiler (not shown).

Downward load, produced when coal is pulverized, must be all received by the reduction mechanism through the yoke 33. The center of the spherical surface formed at the thrust supporting portion of the tilting pad type thrust bearing 18 is positioned between the inside and outside diameters of the vertical portion of the cylindrical case 9, and therefore no bending moment is generated in the cylindrical case 9. Accordingly, the cylindrical case 9 never be deformed to prevent the deterioration of tooth bearing and unequal distribution of power, resulting in the reduction of vibration and noise of the reduction mechanism.

As has been described above, according to the present invention, the case is not deformed because it never be subjected to the moment load, and therefore the tooth bearing of the planetary gear train is not deteriorated, thereby making it possible to reduce the vibration and noise of the reduction mechanism.

Further, the case and the internal gear are formed separately from each other, and therefore the internal gear never be applied with the thrust load to prevent the deterioration of tooth bearing, thereby making it possible to reduce the vibration and noise of the reduction mechanism.

In addition, the sun gear shaft can move freely, and therefore it is easy to distribute the load equally among the three planet gears. In consequence, deformation of the case and unequal load distribution among the planet gears are prevented from taking place, and accordingly the vibration and noise of the reduction mechanism can be reduced.

We claim:

1. A reduction mechanism for mill comprising:

a planetary gear train comprising a sun gear, planet gears, an internal gear and a carrier for supporting said planet gears;

an input shaft for feeding power;

a sun gear shaft which rotates said sun gear mounted thereon;

an intermediate shaft interposed between said sun gear shaft and said input shaft;

an output table for transferring rotary power;

a thrust bearing for supporting said output table; and a case for enveloping said planetary gear train and said thrust bearing, wherein said thrust bearing comprises a tilting pad type bearing, the thrust supporting portion of said tilting pad type bearing being formed spherically, the center of the spherical surface being positioned between inside and outside diameters of a vertical portion of said case which receives a thrust force, and said internal gear is formed separately from the case and fixed thereto using fixing means, and wherein the internal gear is fixed to the case with pins.

2. A reduction mechanism for mill comprising:

a planetary gear train comprising a sun gear, planet gears, an internal gear and a carrier for supporting said planet gears;

an input shaft for feeding power;

a sun gear shaft which rotates said sun gear mounted thereon;

an intermediate shaft interposed between said sun gear shaft and said input shaft;

an output table for transferring rotary power;

a thrust bearing for supporting said output table; and a case for enveloping said planetary gear train and said thrust bearing, wherein said thrust bearing comprises a rolling bearing, the center of the thrust supporting portion of a fixed ring of said rolling bearing being positioned between inside and outside diameters of a vertical portion of said case which receives a thrust force, a width of contact of the fixed ring with said case being made equal to a thickness of the vertical portion of said case.

3. A reduction mechanism for mill comprising:

a planetary gear train comprising a sun gear, planet gears, an internal gear and a carrier for supporting said planet gears;

an input shaft for feeding power;

a sun gear shaft which rotates said sun gear mounted thereon;

an intermediate shaft interposed between said sun gear shaft and said input shaft;

an output table for transferring rotary power;

a thrust bearing for supporting said output table; and a case for enveloping said planetary gear train and said thrust bearing, wherein said case is divided into upper and lower cases, and said thrust bearing comprises a rolling bearing, the center of the thrust supporting portion of a fixed ring of said rolling bearing is positioned between inside and outside diameters of a vertical portion of said lower case which receives a thrust force, a width of contact of the fixed ring with said upper case being made equal to a thickness of a vertical portion of said upper case.

* * * * *